US010154700B2

(12) United States Patent
Bower et al.

(10) Patent No.: US 10,154,700 B2
(45) Date of Patent: Dec. 18, 2018

(54) WEARABLE APPARATUS

(75) Inventors: Chris Bower, Cambridgeshire (GB); Pekka Kilpi, Helsinki (FI); Claudio Marinelli, Cambridge (GB)

(73) Assignee: Nokia Technologies Oy, Espoo (FI)

( * ) Notice: Subject to any disclaimer, the term of this patent is extended or adjusted under 35 U.S.C. 154(b) by 354 days.

(21) Appl. No.: 13/482,225

(22) Filed: May 29, 2012

(65) Prior Publication Data

US 2013/0318676 A1 Dec. 5, 2013

(51) Int. Cl.
*A41D 20/00* (2006.01)

(52) U.S. Cl.
CPC ..... *A41D 20/00* (2013.01); *A41D 2400/62* (2013.01)

(58) Field of Classification Search
CPC ..... A41B 2400/60; A61M 2205/3576; A61M 2205/50; A61M 2205/587; A61M 2205/8206; A61M 2209/088; A61M 35/00; A61M 5/142; A61M 5/14244; A41D 13/0015; A41D 1/00; A41D 1/06; A41D 27/08; A41D 1/04; A41D 15/00; A41D 13/0012; A41D 1/02; A41D 2400/38; A41D 27/20; A41D 13/0058; A41D 15/04; A41D 3/08; A41D 13/00; A41D 13/1209; A41D 13/1245; A41D 13/0153; A41D 13/05; A41D 13/0506; A41D 13/0518; A41D 13/0531; A41D 13/0562; A41D 13/065; A41D 13/08; A41D 13/1281; A41D 15/005; A41D 17/02; A41D 19/0051; A41D 19/0065; A41D 19/0068; A41D 19/01505; A41D 1/002; A41D 20/00; A43B 13/02; A43B 13/187; A43B 5/00; A43B 13/122; A43B 13/14; A43B 13/181; A43B 13/188; A43B 1/0009; A43B 3/0073; A43B 13/04; A43B 13/18; A43B 13/22; A43B 17/00; A43B 17/18; A43B 23/07; A43B 3/0078
USPC ..... 2/69, 53, 54, 310; 428/137, 181, 315.5
See application file for complete search history.

(56) References Cited

U.S. PATENT DOCUMENTS

| | | | | |
|---|---|---|---|---|
| 3,214,375 | A * | 10/1965 | Berkeley | 508/216 |
| 4,613,544 | A * | 9/1986 | Burleigh | 428/315.5 |
| 4,692,369 | A | 9/1987 | Nomi | 428/198 |
| 4,911,169 | A | 3/1990 | Ferrari | 128/641 |
| 5,787,503 | A * | 8/1998 | Murphy, III | 2/90 |
| 6,308,337 | B1 | 10/2001 | Penley | 2/239 |
| 7,682,994 | B2 * | 3/2010 | Van Emden et al. | 442/181 |
| 2003/0077967 | A1 | 4/2003 | Rock et al. | |
| 2006/0085886 | A1 * | 4/2006 | Williams | 2/53 |
| 2007/0011796 | A1 * | 1/2007 | Manzo | 2/310 |
| 2009/0104404 | A1 * | 4/2009 | Polegato Moretti | A41D 31/02 428/137 |

(Continued)

FOREIGN PATENT DOCUMENTS

| | | | |
|---|---|---|---|
| CN | 2867924 | Y | 2/2007 |
| CN | 101014257 | A | 8/2007 |

(Continued)

*Primary Examiner* — Alissa L Hoey
*Assistant Examiner* — Catherine M Ferreira
(74) *Attorney, Agent, or Firm* — Harrington & Smith

(57) ABSTRACT

An apparatus including a structure including a plurality of passages from an interior side of the structure towards an exterior side of the structure; and a hydrophilic wicking material, positioned on at least the interior side of the structure, forming a contact surface for placement adjacent a user's skin.

15 Claims, 3 Drawing Sheets

(56) References Cited

U.S. PATENT DOCUMENTS

2010/0268056 A1 10/2010 Picard et al. ..... 600/288

FOREIGN PATENT DOCUMENTS

| | | | |
|---|---|---|---|
| CN | 101404903 | A | 4/2009 |
| EP | 0777978 | A2 | 6/1997 |
| EP | 1312710 | A1 | 5/2003 |
| JP | S-5093552 | A | 7/1975 |
| JP | H-07213 | A | 1/1995 |
| JP | H-095685 | A | 1/1997 |
| JP | H-1080228 | A | 3/1998 |
| JP | 2002020445 | A | 1/2002 |
| WO | 2006013317 | A2 | 2/2006 |

* cited by examiner

WEARABLE APPARATUS

TECHNOLOGICAL FIELD

Embodiments of the present invention relate to a wearable apparatus.

BACKGROUND

It is challenging to make an apparatus that is wearable next to the skin, in a fixed position, for prolonged periods.

The apparatus would be exposed to elements in the ambient environment yet it would need to remain fixed and comfortable.

BRIEF SUMMARY

According to various, but not necessarily all, embodiments of the invention there is provided an apparatus comprising: a structure comprising a plurality of passages from an interior side of the structure towards an exterior side of the structure; and a hydrophilic wicking material, positioned on at least the interior side of the structure, forming a contact surface for placement adjacent a user's skin.

According to various, but not necessarily all, embodiments of the invention there is provided a method comprising: providing a structure comprising a plurality of passages between an interior side of the structure and an exterior side of the structure; and providing a hydrophilic wicking material, on at least the interior side of the structure wherein the hydrophilic wicking material, on the interior side of the structure, provides a contact surface for placement adjacent a user's skin.

BRIEF DESCRIPTION

For a better understanding of various examples of embodiments of the present invention reference will now be made by way of example only to the accompanying drawings in which.

DETAILED DESCRIPTION

Figure 1:
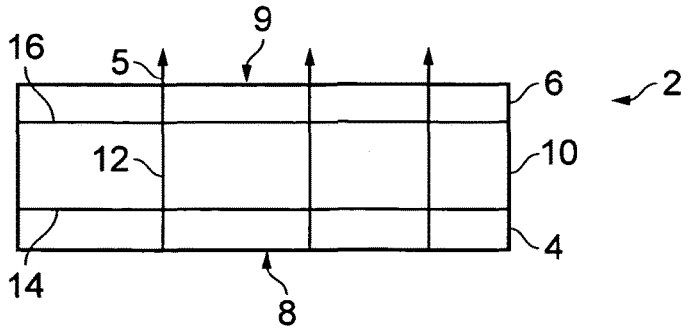
FIG. 1 illustrates, in cross-section, an example of an apparatus comprising an internal structure with passages; a hydrophilic wicking material; and a hydrophobic material.

The Figures illustrate an apparatus 2 comprising: a structure 10 comprising a plurality of passages 12 from an interior side 14 of the structure 10 towards an exterior side 16 of the structure; and a hydrophilic wicking material 4, positioned on at least the interior side 14 of the structure 10, forming a contact surface 8 for placement adjacent a user's skin.

The apparatus 2 is configured to be worn comfortably in a fixed position next to the skin for a long period of time.

The fixed position may, for example, be used to fixedly position a small electronic device. The electronic device may be integrated within the apparatus 2. An example of an electronic device is a sensor.

The apparatus 2 has 'breathability'. Moisture produced by a user's skin at the interface between their skin and the apparatus 2 can escape from the region (contact surface 8) in contact with their skin, thus preventing sweating and discomfort. The apparatus 2 may therefore be comfortable even if worn continuously for days, both throughout the day and at night.

In FIG. 1, the apparatus 2 comprises: an internal structure 10 with passages 12; and a hydrophilic wicking material 4.

The internal structure 10 comprises a plurality of passages 12 between an interior side 14 of the internal structure 10 and an exterior side 16 of the internal structure 10.

In this example, the internal structure 10 is resilient. It can be deformed by a user from its equilibrium rest state and when the deformation force is removed the internal structure 10 returns to its equilibrium rest state. In other examples, resilience may be provided by a component additional to the internal structure 10.

In this illustrated example, the internal structure 10 is both resiliently flexible and stretchable. These properties enable the apparatus 2 to be fixed in position, for example, as a wrist band without causing too much discomfort to the user. The degree of flex and stretch may be controlled by selecting material for use as the internal structure 10 that has a desired elasticity and/or by controlling the characteristics of the passages 12.

The resilient internal structure 10 may, in some examples, be formed from a hydrophilic material.

The plurality of passages 12 provide routes by which fluid travels from the interior side 14 of the internal structure 10 to the exterior side 14 of the internal structure 10.

The passages 12 may reduce the mass of the apparatus 2 and improve its stretching properties.

In some embodiments, some or all of the passages 12 are dimensioned to enable transport of gas, such as water vapour, by diffusion. That is the internal structure 10 is aerated by a diffusion gradient across the passages 12. In some but not necessarily all examples, the passages 12 may be dimensioned to have a minimum diameter of 1 mm, they may in some circumstances additionally or alternatively have a maximum diameter of 10 mm.

In some embodiments, some or all of the passages 12 are dimensioned to enable transport of liquid for example water, by capillarity. In some but not necessarily all examples, the passages 12 may be dimensioned to have a minimum diameter of 0.01 μm, they may in some circumstances additionally or alternatively have a maximum diameter of 100 μm. For example, the internal structure 10 may be formed from an intrinsically porous material with convoluted passages. An example of an intrinsically porous material that might be used is a block-copolymer template material which contains two immiscible polymer blocks which cause controlled phase separation into a porous matrix, once one of the phases is removed.

The hydrophilic wicking material 4, positioned on the interior side 14 of the internal structure 10, forms an exterior contact surface 8 for placement adjacent a user's skin.

The hydrophilic nature of the wicking material 4 enables the rapid ingress of water and the transport of moisture away from the skin adjacent the contact surface 8.

The wicking material 4 may be formed from a porous material. Examples of suitable material include, but are not limited to: woven or non-woven fibres; polymers (e.g. Polypropylene (PP), Polyester); cellulose or natural textile such as cotton or Merino Wool; technical textile such as Polartec® which uses a bi-component structure of aligned fibres to draw in moisture and spread it laterally. The porous material may be formed from a phase separated polymer or block copolymer system, to produce a continuous or bi-continuous pore network with well controlled morphology. E.g. an array of cylindrical pores or a gyroid phase bi-continuous network of pores.

The apparatus 2 may also comprise a hydrophobic material 6. The hydrophobic material 6 is positioned on the exterior side 16 of the internal structure 10. The passages 12 may thus enable moisture transport towards the hydrophobic material 6.

The hydrophobic material 6 provides an exterior non-contact surface 9 of the apparatus 2. It may be water and stain resistant and may be easy to clean. However, it still enables water vapour 5 provided by the wicking material 4 from an interior of the apparatus 2 to pass through it. The evaporation of water vapour 5 from the hydrophobic material 6 into the ambient environment lowers the temperature of the apparatus 2.

The hydrophobic material may be configured so that it does not contact the user's skin when the apparatus 2 is in use. The hydrophobic material may also be configured so that it does contact the skin in some areas, but still leaves a substantial area of the hydrophilic material in contact with the skin. For instance in FIG. 2, layer 6 may extend beneath region 16 to some extent, which might help to prevent dirt ingress whilst still allowing for effective moisture removal.

The hydrophobic material 6 may have been treated to have a low surface energy to render it more hydrophobic.

The hydrophobic material may be porous to provide capillarity.

The hydrophobic material may additionally be oleophobic. This may provide additional stain resistance.

Suitable materials for the hydrophobic material 6 may include:

porous Polytetrafluoroethylene (PTFE) or other fluoropolymer materials which have intrinsically low surface energy;

Porous Nylon, Polyester, Polypropylene which are subsequently treated with a hydrophobic material to lower their intrinsic surface energy, so as to improve the resistance of this outer layer to water ingress, stains and dirt adhesion, whilst still allowing water vapor to evaporate from the wicking material below.

The hydrophobic material 6 may be created by deposition of a porous hydrophobic material on the outer surface of the hydrophilic wicking material 4, for instance by using a plasma deposition, dip-coating or spraying of a fluoropolymer, silicone, fluoro-silicone or wax-like material. In this way, a porous hydrophobic layer can be created on the outer surface.

Figure 2:
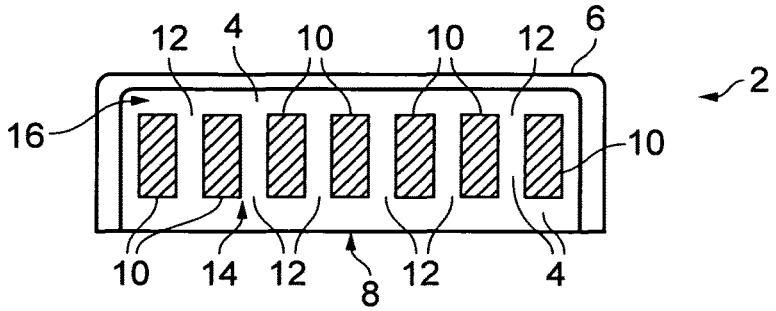
FIG. 2 illustrates, in cross-section, another example of an apparatus comprising an internal structure with passages; a hydrophilic wicking material; and a hydrophobic material.
Figure 4:
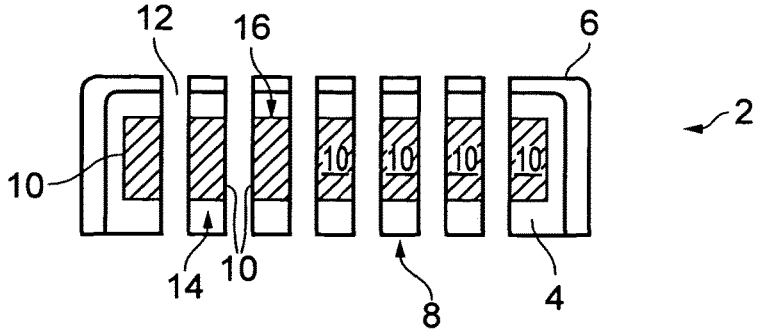
FIG. 4 illustrates, in cross-section, a further example of an apparatus comprising an internal structure with passages; a hydrophilic wicking material; and a hydrophobic material.
Figure 5:
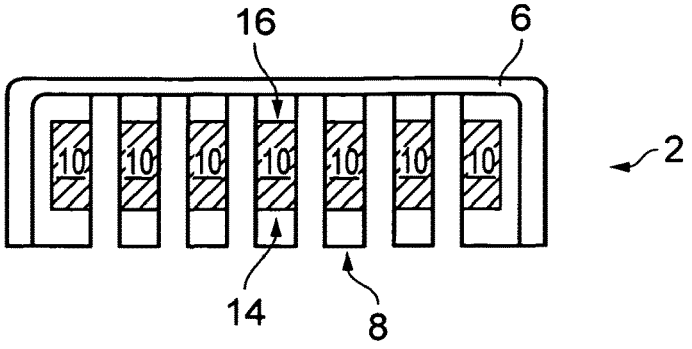
FIG. 5 illustrates, in cross-section, another example of an apparatus comprising an internal structure with passages; a hydrophilic wicking material; and a hydrophobic material.

FIGS. 2, 4 and 5 illustrate alternative examples of an apparatus 2 similar to that illustrated in FIG. 1 and similar features are labelled with similar references. In these Figures, the apparatus 2 comprises: an internal structure 10 comprising a plurality of passages 12 between an interior side 14 of the internal structure 10 and an exterior side 16 of the internal structure; a hydrophilic wicking material 4, positioned to at least the interior side 14 of the internal structure 10, forming a contact surface 8 for placement adjacent a user's skin; and a hydrophobic material 6 positioned to at least the exterior side 16 of the internal structure 10.

In these examples, the hydrophobic material 6 wraps around the apparatus 2 on all sides covering all of the exterior regions of the apparatus 2 except the contact surface 8 where the hydrophilic wicking material 4 is exposed. This limits exposure of the hydrophilic wicking material 4 to only the contact surface 8. When the apparatus 2 is in use and fixedly held against a user's skin, the wicking material 4 is not exposed to the ambient environment but is exposed only to the user's skin and the air trapped in the local micro-environment between the user's skin and the contact surface 8. Therefore water at the user's skin surface may be absorbed by the hydrophilic wicking material 4 but water in the ambient environment may not. This allows the apparatus 2 to be waterproof in use.

The resilient internal structure 10 in this example forms a core of the apparatus 2 that is unexposed at any exterior surface of the apparatus. However, in other implementations the resilient structure 10 may be at least partially exposed externally. It may for example, form part of the contact surface 8 and/or the exterior non-contact surface 9.

In the examples of FIGS. 2, 4 and 5, the resilient internal structure 10 is formed from a single piece of elastic material. The material may be elastomeric. As an example, the resilient internal structure 10 may be formed from polyurethane or silicone.

Figure 3:
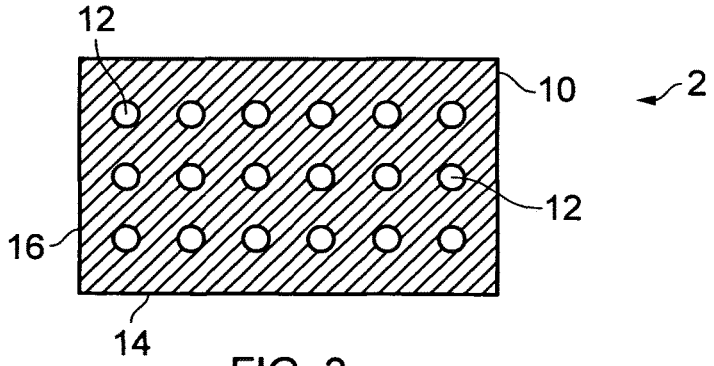
FIG. 3 illustrates, in plan-view, one example of an internal structure with passages.

As illustrated in cross-section in FIGS. 2, 4 and 5 and in top-plan view in FIG. 3, the resilient internal structure 10 comprises a web formed from a continuum of material that has a plurality of holes through the continuum. The holes provide the plurality of passages 12.

In the examples of FIGS. 2, 4 and 5, each of the passages 12 is parallel to the other passages and has a constant cross-sectional area. The passages extend orthogonally between planes defined by the interior side 14 and the exterior side 16 of the internal structure 10.

Referring to FIG. 2, the hydrophilic wicking material 4 extends into some or all of the passages 12. The hydrophilic wicking material 4 is positioned on the interior side 14 of the internal structure 10, on the exterior side 16 of the internal structure 10 and extends through the passages 12 in the internal structure between the interior side 14 and the exterior side 16 of the internal structure 10. The hydrophilic wicking material 4 therefore provides a continuum of material between the contact surface 8, through the internal structure 10 to the hydrophobic material 6.

In this example, the cross-sectional diameter of the passages 12 may be too large to support capillarity without the presence of the hydrophilic wicking material 4. The hydrophilic wicking material 4 transports any moisture from the contact surface 8 through the passages 12 directly to the hydrophilic material 6 at the exterior surface 9 of the apparatus 2 where it evaporates.

In contradistinction to the example of FIG. 2, in FIGS. 4 and 5, the passages 12 between the interior side 14 of the internal structure 10 and an exterior side 16 of the internal structure 10 are empty of hydrophilic material 4.

In FIG. 4, the passages 12 between an interior side 14 of the internal structure 10 and an exterior side 16 of the internal structure 10 extend from the contact surface 8 of the apparatus 2 to the exterior upper surface 9 of the apparatus 2 through the hydrophilic wicking material 4, the internal structure 10 and the hydrophobic material 6. Apertures in the resilient internal structure 10 are left empty and coincide with holes in the hydrophilic wicking material 4 and the hydrophobic material 6. The passages 12 are therefore open at the lower contact surface 8 and the exterior upper surface 9.

Moisture on the skin may directly evaporate into the open passages 12.

Additionally or alternatively some or all of the passages 12 may be sized to enable capillarity. The capillarity transports moisture through the passages 12 instead of using the wicking material 4 to provide transport through the passages 12.

The wicking material 4 may still be positioned above, below and to the sides of the internal structure and this may provide a transport route for moisture to the exterior upper surface 9.

In FIG. 5, the passages 12 between an interior side 14 of the internal structure 10 and an exterior side 16 of the internal structure 10 extend from the contact surface 8 of the apparatus 2 to but not through the hydrophobic material 6. Apertures in the resilient internal structure 10 are left empty and coincide with holes in the hydrophilic wicking material 4. The passages 12 are therefore open at the lower contact surface 8 but covered at the exterior upper surface 9.

Moisture on the skin may directly evaporate into the open passages 12.

Additionally or alternatively some or all of the passages 12 may be sized to enable capillarity. The capillarity transports moisture through the passages 12 instead of using the wicking material 4 to provide transport through the passages 12.

The wicking material 4 may still be positioned above, below and to the sides of the internal structure and this may provide a transport route for moisture to the exterior upper surface 9.

Other embodiments are possible where the passages 12 are covered by the wicking material 4 positioned at the top of the passages 12, between the hydrophobic material 6 and the internal support 10 and/or covered by the wicking material 4 positioned at the bottom of the passages 12 between the contact surface 8 and the internal support 10.

Figure 6:
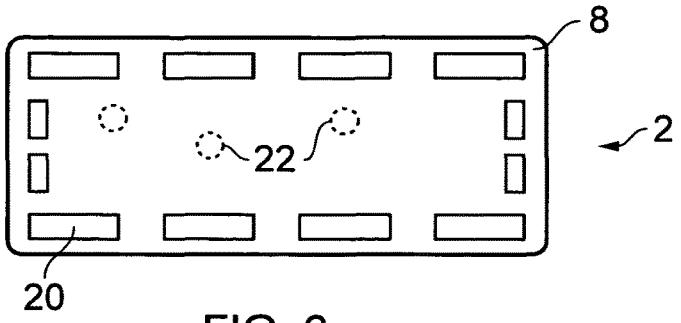
FIG. 6 illustrates, in plan-view, one example of a contact surface of an apparatus.

FIG. 6 illustrates an underside of an example of an apparatus 2, as previously described. In this example, the contact surface 8 is illustrated.

In this example, the contact surface 8 comprises opening (s) 22 to sensor(s), for example one or more bio-monitoring sensors including motion and/or life sign monitoring and/or physiological sensors.

In this example, the contact surface 8 comprises friction grip areas 20, which may be protruding pads. The friction grip areas 20 are positioned towards a periphery of the contact area 8 and form an intermittent perimeter around a central portion of the contact area 8 where the openings 22 are located.

The friction grip areas 20 may be provided by pads protruding from the contact surface 8. The gaps in the intermittent perimeter between the protruding pads 20 may allow for air flow so that moisture can escape from the skin, keeping the assembly cool and comfortable to wear. Silicone, elastomer or some other material with a high coefficient of friction may be used for the protruding pads 20 as it provides good grip combined with deformability which makes the device comfortable to wear against the skin. The friction grip areas 20 provide sufficient grip to hold the sensor openings 22 at a fixed position during use.

Figure 7:
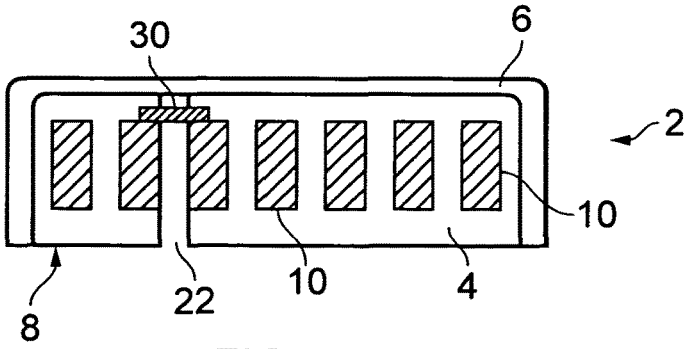
FIG. 7 illustrates, in cross-section, another example of an apparatus comprising an internal structure with passages; a hydrophilic wicking material; and a hydrophobic material.

FIG. 7 illustrates an example of an apparatus 22, where the contact surface 8 comprises an opening 22 to an electronic device 30.

The electronic device 30 is, in this example a sensor. The sensor may be any suitable sensor. It may, for example be a bio-monitoring sensor, a motion sensor, a life sign monitoring sensor or a physiological sensor.

In this example, the electronic device 30 is mounted above the internal structure 10 between the internal structure 10 and the hydrophobic material 6. It is positioned at the top of a passage 12 through the internal structure 10. The passage 12 is similar to that described in relation to FIG. 5. It is open at the bottom contact surface 8 but closed by the hydrophobic material 6.

To avoid making the overall thickness of the apparatus 10 variable, the internal structure may be recessed at its exterior side 16 to accommodate the electronic device 30.

Figure 9A:
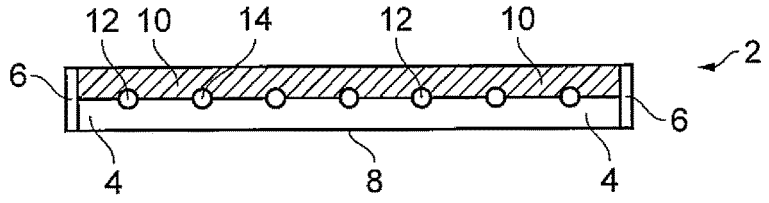
FIGS. 9A and 9B illustrate an alternative example of an apparatus similar to that illustrated in FIG. 1 but with lateral passages.
Figure 9B:
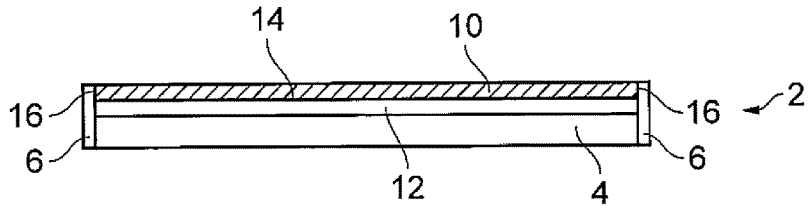
Figure 10:
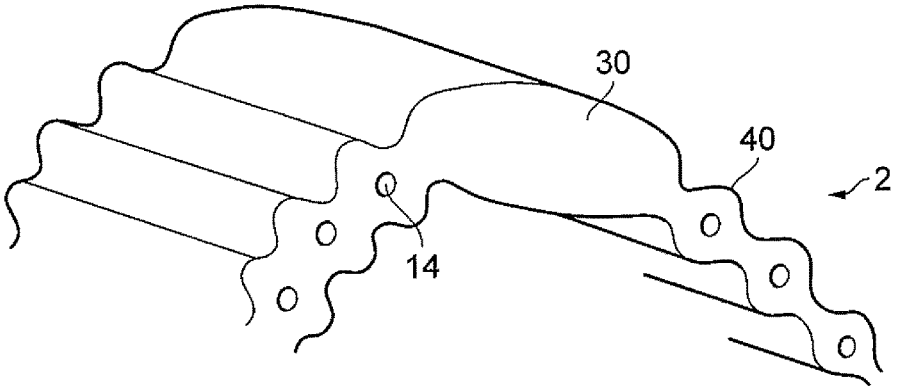
FIG. 10 illustrates an example of an apparatus configured as a strap.

FIGS. 9A, 9B and 10 illustrate alternative examples of an apparatus 2 similar to that illustrated in FIG. 1 and similar features are labelled with similar references. In these Figures, the apparatus 2 comprises: a structure 10 comprising a plurality of passages 12 between an interior side 14 of the structure 10 and an exterior side 16 of the structure 10 and hydrophilic wicking material 4, positioned to at least the interior side 14 of the structure 10, forming a contact surface 8 for placement adjacent a user's skin. The apparatus 2 may also comprise a hydrophobic material 6 positioned to at least the exterior side 16 of the structure 10.

FIGS. 9A and 9B illustrate mutually orthogonal cross-sectional views of the apparatus. As can be seen from FIG. 9A, the passages 12 are formed at an interface between the structure 10 and the hydrophilic wicking material 4.As can be seen from FIG. 9B the passages extend laterally substantially parallel to the contact surface 8 between lateral sides of the apparatus 2. In this example, the passages 12 have a constant cross-sectional area.

In this example, the hydrophobic material 6 wraps around the lateral sides of the apparatus 2 covering the exterior apertures of the passages 12.

The hydrophilic wicking material 4 does not extend into the passages 12.

Figure 8:
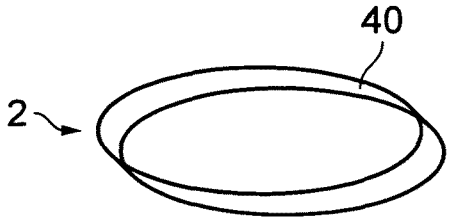
FIG. 8 illustrates, in perspective view, another example of an apparatus comprising an internal structure with passages; a hydrophilic wicking material; and a hydrophobic material that is formed as a strap.

FIG. 8 illustrates an example of one of many applications of the apparatus 2. In this example, the apparatus 2 forms a breathable strap 40.

In this example the strap is formed as a stretchable continuous loop, which may be stretched to fit over a hand onto a wrist with a close fit.

In other examples, the strap may have an adjustable fastener for attaching the strap 40 with a close fit.

In some embodiments, the internal structure 10 may be formed such that it has a strain dependent color, for example, using a polymer opal type material, which provides an indication of when the correct tension has been achieved to hold the electronic device 30 stationary to allow for accurate monitoring. In this embodiment, the hydrophilic material should be translucent or transparent so that the color change can be observed through the exterior upper surface 9, alternatively the hydrophobic material 6 could, alternatively, be formed from material that has a stretch dependent color.

Transverse structures may be added to the strap 40 that resist reduction of width when it is stretched.

Some or all of the components of the apparatus 2 may be treated with bacteria-killing substances, such as silver particles The strap 40 resists water ingress from the ambient environment and has good water, stain, and dirt resistance. It may be used indoors where it may be exposed to dirt and rain and outdoors where it may be exposed to pressurised water from a tap or shower or submerged in water and detergents.

The strap 40 provides for transport of moisture from the skin where it is worn and the evaporation of that moisture to the ambient environment. This keeps the skin dry and cool.

The strap is comfortable yet secure and provides reliability of bio-monitoring and comfort that enables the strap 40 to be worn continuously 24 hours a day, seven days a week.

Being able to achieve water resistance, breathability and secure attachment is particularly challenging. It is achieved by using, as a combination, an internal structure 10 with passages 12; a hydrophilic wicking material 4 forming a contact surface 8 for placement adjacent a user's skin; and a hydrophobic material 6.

FIG. 10 illustrates another example of a strap that has laterally extending passages 12 (as described with reference to FIGS. 9A and 9B). In this example, the strap 40 is for an electronic device 30, which may be a sensor.

It should be appreciated that the apparatus 2 described may be implemented as a strap 40 as illustrated in FIG. 8 or in other configurations. Application devices such as watches, electronic circuitry, sensors etc may, depending on application, be mounted within the apparatus 2, mounted on top of the apparatus 2 or suspended between two ends of the apparatus 2. In this latter case, the application device and apparatus 2 in combination form a wrist-band.

It should be appreciated that the apparatus 2 described may have a wide application to different fields such as, for example, fitness, wellness, healthcare, lifestyle, entertainment, data collection and social networking.

It should be appreciated that although the electronic device 30 is described only in relation to FIG. 7 and the apertures for a sensor 22 are described only with reference to FIGS. 6 and 7 one or both of these features may be present in any of the examples of the apparatus 2 described.

It should be appreciated from the foregoing description that according to various, but not necessarily all, embodiments of the invention there is provided a method comprising: providing an internal structure 10 comprising a plurality of passages 12 between an interior side 14 of the internal structure 10 and an exterior side 16 of the internal structure 10; providing a hydrophilic wicking material 4, on at least the interior side 14 of the internal structure 10; and providing a hydrophobic material 6 to at least the exterior side 16 of the internal structure 10, wherein the hydrophilic wicking material 4, on the interior side 14 of the internal structure 10, provides a contact surface 8 for placement adjacent a user's skin.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a structure formed from a single piece of resiliently deformable material, the structure comprising a plurality of passages through the single piece of resiliently deformable material from an interior side of the structure towards an exterior side of the structure, wherein the passages have a diameter between 1 and 10 mm;

a hydrophilic wicking material, different from the resiliently deformable material, positioned on at least the interior side of the structure, forming an exterior contact surface of the apparatus wherein the hydrophilic wicking material extends from the interior side of the structure to the exterior side of the structure through at least some of the passages in the structure through the resiliently deformable material; and wherein the apparatus is configured as part of a breathable user-wearable strap.

2. An apparatus as claimed in claim 1, wherein at least one other of the plurality of passages through the resiliently deformable material between the interior side of the structure and the exterior side of the structure is empty of the hydrophilic wicking material.

3. An apparatus as claimed in claim 1 further comprising a hydrophobic material positioned to at least the exterior side of the structure, wherein the resiliently deformable material is between the hydrophobic material and the exterior contact surface of hydrophilic wicking material.

4. An apparatus as claimed in claim 3, wherein the hydrophobic material extends over an exterior upper surface of the single piece of, resiliently deformable material and extends over the sides of the single piece of resiliently deformable material towards the contact surface but is configured such that it does not contact the user's skin in use.

5. An apparatus as claimed in claim 3, wherein the hydrophobic material is additionally oleophobic.

6. An apparatus as claimed in claim 3 wherein the hydrophobic material is porous.

7. An apparatus as claimed in claim 1 wherein the structure is an internal structure comprising a plurality of passages between an interior side of the internal structure and an exterior side of the internal structure.

8. An apparatus as claimed in claim 1, wherein the passages are dimensioned to enable transport of gas by diffusion.

9. An apparatus as claimed in claim wherein the structure is formed from a hydrophilic material comprising said passages.

10. An apparatus as claimed in claim 1, further comprising at least one electronic component positioned to the exterior side of the structure and aligned with at least one of the passages through the internal structure.

11. A method comprising:

providing a structure formed from a single piece of resiliently deformable material, the structure comprising a plurality of passages through the single piece of resiliently deformable material between an interior side of the structure and an exterior side of the structure, wherein the passages have a diameter between 1 and 10 mm; and providing a hydrophilic wicking material, different from the resiliently deformable material, on at least the interior side of the structure wherein the hydrophilic wicking material, on the interior side of the structure, provides an exterior contact surface of the apparatus; and providing hydrophilic wicking material extending from the interior side of the structure to the exterior side of the structure through at least some of the passages in the structure through the resiliently deformable material, wherein the apparatus is configured as part of a breathable user-wearable strap.

12. A method as claimed in claim 11 further comprising: providing a hydrophobic material to at least the exterior side of the structure.

13. An apparatus comprising:

a structure formed from a single piece of resiliently deformable material, the structure comprising a plurality of passages through the single piece of resiliently deformable material from an interior side of the structure towards an exterior side of the structure, wherein the passages have a diameter between 1 and 10 mm;

a hydrophilic wicking material, different from the resiliently deformable material, positioned on at least the interior side of the structure, forming a first part of an exterior contact surface of the apparatus, wherein the hydrophilic wicking material extends from the interior side of the structure to the exterior side of the structure through at least some of the passages in the structure through the resiliently deformable material; and protruding friction grip portions comprising material different from the hydrophilic wicking material, and forming a second part of the exterior contact surface of the apparatus, wherein the second part of the exterior contact surface is different from the first part of the exterior contact surface.

14. An apparatus as claimed in claim 1, wherein at least some of the plurality of passages between the interior side of the structure and the exterior side of the structure extend from the contact surface of the apparatus through the resiliently deformable material to an exterior surface of the apparatus such that those passages are aligned with apertures in the contact surface and in the exterior surface of the apparatus.

15. An apparatus as claimed in claim 1, wherein the hydrophilic wicking material on the interior side of the structure extends between at least some of the plurality of passages.

* * * * *